US010507357B2

(12) United States Patent
Fitzsimmons

(10) Patent No.: US 10,507,357 B2
(45) Date of Patent: Dec. 17, 2019

(54) FOOT STRETCHING DEVICE

(71) Applicant: Sean Fitzsimmons, New York, NY (US)

(72) Inventor: Sean Fitzsimmons, New York, NY (US)

( * ) Notice: Subject to any disclaimer, the term of this patent is extended or adjusted under 35 U.S.C. 154(b) by 176 days.

(21) Appl. No.: 15/648,762

(22) Filed: Jul. 13, 2017

(65) Prior Publication Data

US 2019/0015698 A1 Jan. 17, 2019

(51) Int. Cl.

| | |
|---|---|
| ***A63B 23/10*** | (2006.01) |
| ***A63B 23/08*** | (2006.01) |
| *A63B 23/00* | (2006.01) |
| *A63B 21/00* | (2006.01) |
| *A63B 23/035* | (2006.01) |
| *A63B 23/04* | (2006.01) |

(52) U.S. Cl.

CPC ..... *A63B 23/10* (2013.01); *A63B 23/08* (2013.01); *A63B 21/00047* (2013.01); *A63B 21/4013* (2015.10); *A63B 21/4015* (2015.10); *A63B 23/03508* (2013.01); *A63B 23/04* (2013.01); *A63B 2023/006* (2013.01)

(58) Field of Classification Search

CPC ..... A63B 21/00047; A63B 21/00178; A63B 21/4013; A63B 21/4015; A63B 23/10; A63B 23/08; A63B 23/03508; A63B 23/04; A63B 2023/006

See application file for complete search history.

(56) References Cited

U.S. PATENT DOCUMENTS

| | | | |
|---|---|---|---|
| 3,401,931 | A | 9/1968 | McCafferty et al. |
| 4,429,868 | A | 2/1984 | LeBlanc et al. |
| 4,561,649 | A | 12/1985 | Forsythe |
| 5,056,507 | A | 10/1991 | Yum |
| 5,087,036 | A | 2/1992 | Cooper |
| 5,433,684 | A | 7/1995 | Carrillo |
| 6,110,078 | A | 8/2000 | Dyer |

(Continued)

FOREIGN PATENT DOCUMENTS

| | | | |
|---|---|---|---|
| JP | 09206346 | A | 8/1997 |
| WO | 8401723 | A1 | 5/1984 |

OTHER PUBLICATIONS

ProStretch Calf Stretcher and Foot Rocker (The Original), product description and drawings, https://www.amazon.com/ProStretch-Calf-Stretcher-Original-Medi-Dyne/dp/B000GAAX . . . Aug. 18, 2017 (8 pgs).

(Continued)

*Primary Examiner* — Megan Anderson

(74) *Attorney, Agent, or Firm* — Dicke, Billig & Czaja, PLLC

(57) ABSTRACT

A foot stretching device having a base member, an upright member and a heelpiece. The base member has a top face, a bottom face, a first end, and a second end. In an assembled state, the upright member extends from the first end in a direction opposite the bottom face. The upright member and base member form a right angle. The heelpiece is removably attached to the top face of the base member between the first and second ends. During use, the device is arranged relative to a corner formed between a floor and wall of a room such that the bottom face of the base member rests on the floor and the upright member bears against the wall.

13 Claims, 7 Drawing Sheets

(56) References Cited

U.S. PATENT DOCUMENTS

| | | | | |
|---|---|---|---|---|
| 6,244,992 | B1 | 6/2001 | James | |
| 6,589,141 | B1 | 7/2003 | Flaggs | |
| 7,291,103 | B1 | 11/2007 | Estwanik | |
| 8,939,872 | B2 * | 1/2015 | Sprague | A63B 21/00047 297/423.1 |
| 9,415,260 | B2 * | 8/2016 | Islas | A63B 23/10 |
| 2003/0047979 | A1 | 3/2003 | Carom | |
| 2004/0259695 | A1 | 12/2004 | Cardarelli | |
| 2005/0014612 | A1 | 1/2005 | Sugiyama et al. | |
| 2006/0103219 | A1 | 5/2006 | Sardana | |
| 2008/0312051 | A1 * | 12/2008 | Manyseng | A63B 9/00 482/92 |
| 2009/0062699 | A1 | 3/2009 | Yang | |
| 2013/0184126 | A1 | 7/2013 | Kole et al. | |
| 2014/0100086 | A1 | 4/2014 | Pagliaro | |
| 2017/0354839 | A1 * | 12/2017 | Reque | A63B 21/4035 |

OTHER PUBLICATIONS

Fitaboo Adjustable Wood Slant Board, product description and drawings, https://www.amazon.com/dp/B018E5XR2U?psc=1 Aug. 18, 2017 (7 pgs).

Dovetail joint—Wikipedia, https://en.wikipedia.org/wiki/Dovetail_joint Aug. 18, 2017 (5 pgs).

* cited by examiner

FOOT STRETCHING DEVICE

BACKGROUND

The present disclosure relates to personal stretching devices. More particularly, it relates to portable foot stretching devices for personal use, for example in the treatment of plantar fasciitis.

Plantar fasciitis is a common ailment that causes pain in the heel of the foot. Because the plantar fascia extends along the arch on the bottom of the foot, the pain associated with plantar fasciitis is typically experienced when walking or putting pressure onto the bottom of the foot.

Treatment of plantar fasciitis may include rest, ice, medications, shoe wear modifications, and/or physical therapy. Exercises that treat plantar fasciitis aim to stretch the foot and ankle, and usually focus on stretching the Achilles tendon and plantar fascia.

A typical stretch to treat plantar fasciitis is performed by pulling the toes backwards towards the ankle and shin, thus elongating the plantar fascia. The foot should be held in this position for 10 to 20 seconds, and repeated several times. Often, this stretch requires a person to be seated to maintain balance. Additionally, this stretch may be performed by placing a towel under the ball of the foot and pulling backwards on the ends of the towel in order to pull the toes towards to ankle and shin. Another typical plantar fascia and calf stretch is performed while standing on a step. The stretch is performed by balancing the toes on the edge of the step, with the heel overhanging the edge of the step. Next, the heel is lowered slowly over the edge of the step. The bottom of the foot and the muscles in the back of the leg will stretch as the heel is lowered towards the floor. The stretch should be held for 10 to 20 seconds. These exercises may fail to properly stretch the foot and ankle, and do not always result in resolution of the patient's symptoms.

A variety of therapeutic devices that facilitate the stretching of the heel exist for treatment of plantar fasciitis. Some plantar fasciitis treatment devices act as a brace or splint to hold the foot in a stretched position with the toes pulled backwards towards the shin for an extended period of time. These devices are most useful when the user is immobile for a long period of time, i.e. overnight. Other plantar fasciitis devices utilize a wedge or angled platform that lifts the foot upwards or backwards towards the shin to stretch the heel. These devices are limited in their use because they often define a single angle or few angles, which may not be the optimum angle for a particular patient. Additionally, these devices may be bulky and not easy to store for in-home use.

Therefore, there is a need to provide a device that can enable a proper foot and ankle stretch to treat plantar fasciitis and is easily transportable.

DETAILED DESCRIPTION

The following description describes embodiments of a foot stretching device including a base member, an upright member, and a heelpiece.

Figure 1:
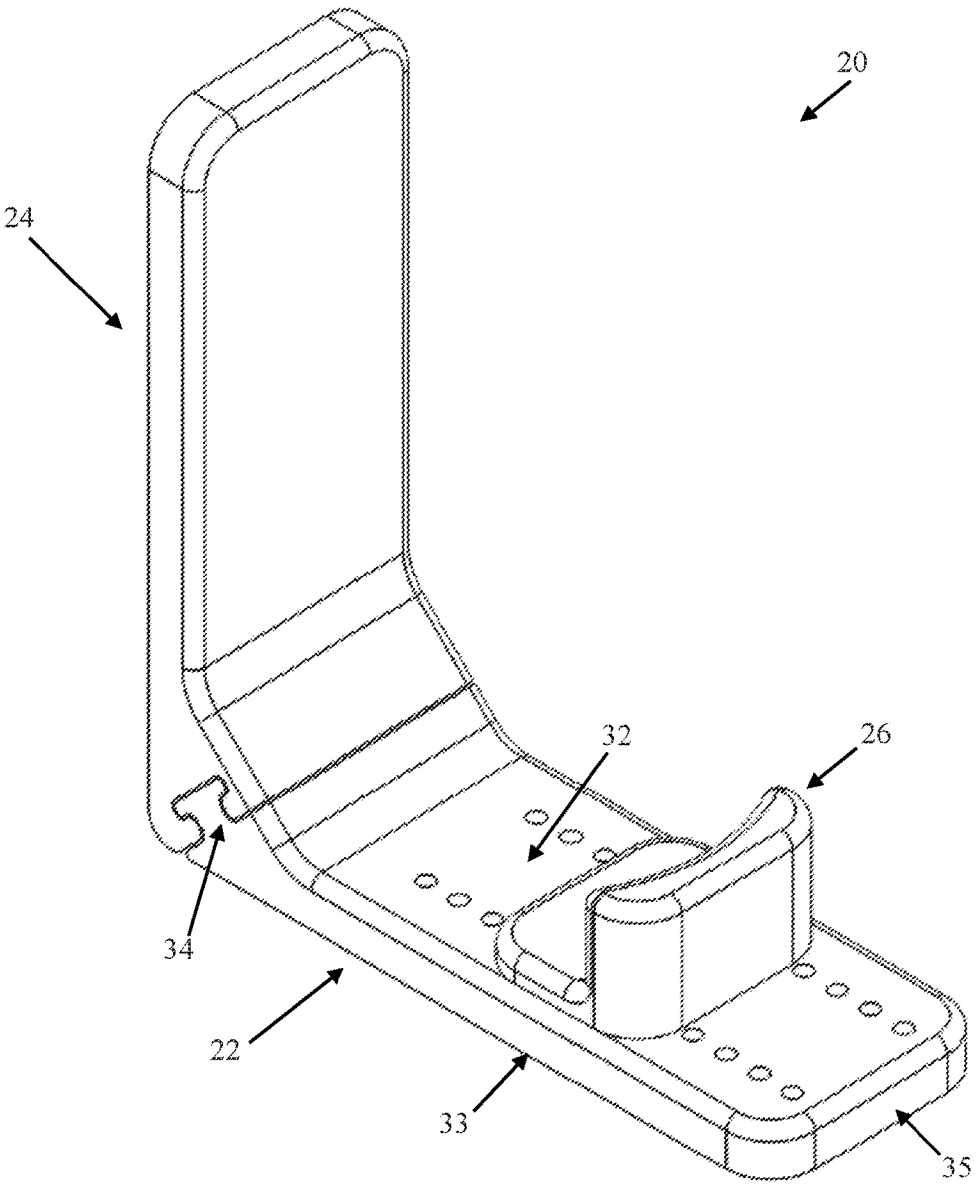
FIG. 1 is a perspective view of a foot stretching device in accordance with principles of the present disclosure.

FIG. 1 illustrates one embodiment of a foot stretching device 20 in accordance with principles of the present disclosure. The foot stretching device 20 shown comprises a base member 22, an upright member 24, and a heelpiece 26. Details on the various components 22-26 are described in greater detail below. In general terms, the base member 22 is connected to the upright member 24 in the assembled state of FIG. 1, arranged at an angle highly conducive to placement at a corner formed between a floor and a wall as commonly found the room of any home, office, etc. The heelpiece 26 is connected to the base member 22 at a location relative to the upright member 24 as desired by the user (e.g., to best-accommodate a size of the user's foot). During use, the foot stretching device 20, in the assembled state, is placed at the corner of a room (i.e., a corner formed by the floor and a wall of the room), with the base member 22 resting against the floor and the upright member 24 in contact with the wall. The user arranges his/her foot such that a heel of the foot is against the heelpiece 26 and a forefoot (e.g., toes and/or ball) of the foot is against the upright member 24. By then leaning forward and/or pressing down on the toes, an efficient foot, heel, and calf stretch is achieved. Generally, the force of the upright member 24 against the wall and the force of the base member 22 against the floor hold the foot stretching device 20 in place during use. In an optional storage state (not shown) of the device 20, the base member 22 is disassembled from the upright member 24; the base member 22 and the upright member 24 can then be laid against one another in a more compact footprint conducive to storage.

The base member 22 has an elongated shape, defining a top face 32 opposite a bottom face 33 (referenced generally), and a first end 34 opposite a second end 35. A majority of the top face 32 can be substantially flat and planar (i.e., within 10% of a truly flat and planar surface) in extension from the second end 35 toward the first end 34. The first end 34 is configured for coupling to the upright member 24 as described in greater detail below. With this in mind, in a region of the first end 34, a shape of the base member 22 along the top face 32 can transition upwardly (relative to the bottom face 33) so as to locate the upright member 24 upwardly relative to the top face 32 (in the assembled state), optionally forming a right angle between the base member 22 and the upright member 24 (e.g., a plane of the bottom face 33 and a plane of the upright member 24 are perpendicular). The heelpiece 26 is removably attached to the top face 32 of the base member 22. The heelpiece 26 may be attached at various locations between the first end 34 and the second end 35 of the base member 22. It should be noted that both the heelpiece 26 and the upright member 24 project in the same direction (e.g., upwardly) from the top face 32 of base member 22. A selected location of the heelpiece 26 along the base member 22 (and thus relative to upright member 24) corresponds to the size of the user's foot.

The foot stretching device 20 is configured for use by placing the device at the corner formed between a floor and wall. The foot stretching device 20 is arranged such that the base member 22 rests on a floor of a room and the upright member 24 is positioned against a wall of the room. Thus, the base member 22 can be substantially parallel to the floor, the upright member 24 can be substantially parallel to the wall, and can form a right angle to one another. It will be understood, however, that in some use applications, the base member 22 and the upright member 24 can slightly deflect relative to one another and/or be arranged at a non-perpendicular angle, for example to accommodate wall moldings or other adaptations in the floor/wall interface.

Figure 2:
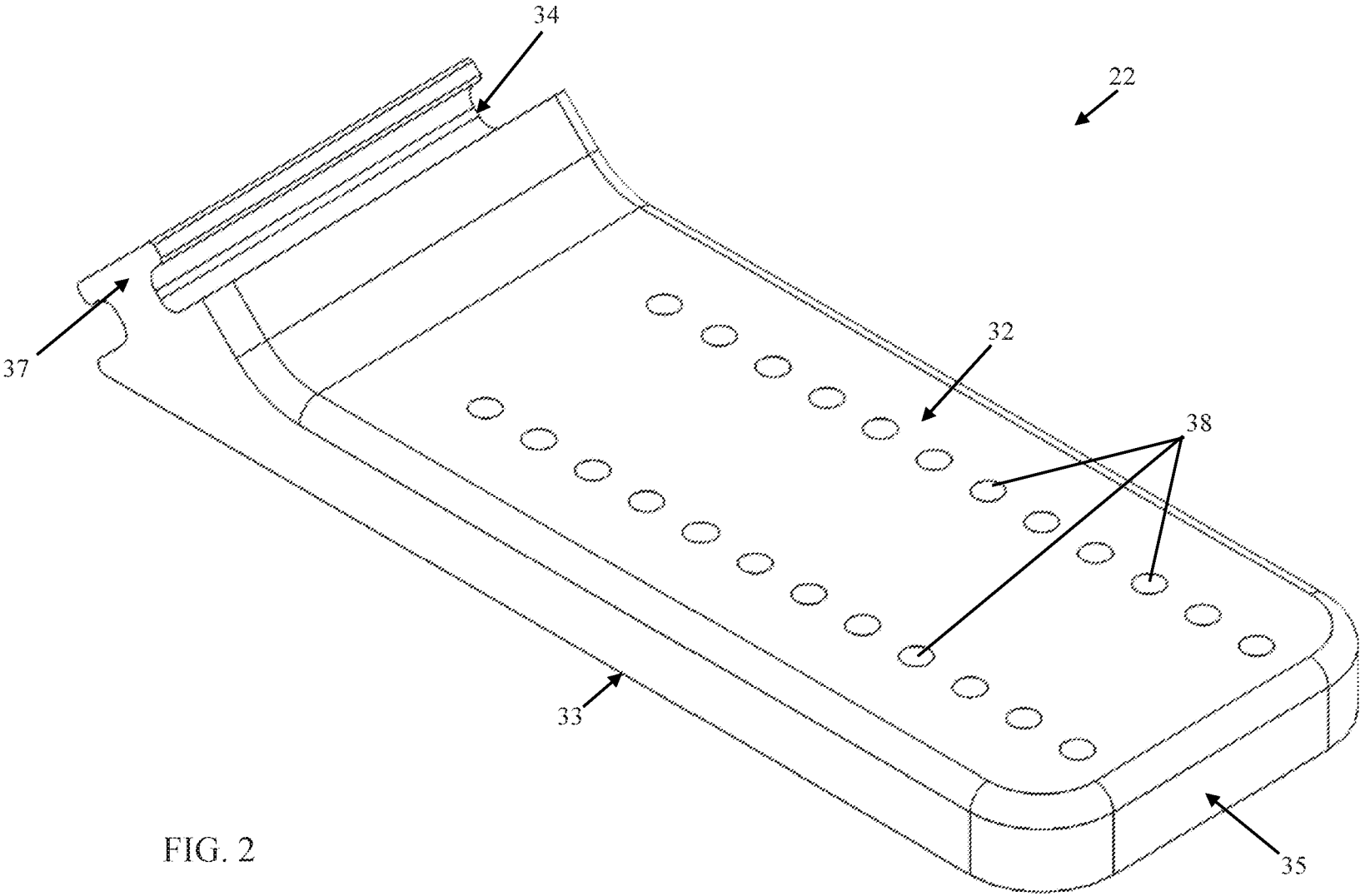
FIG. 2 is a perspective view of a base member of the foot stretching device of FIG. 1.

As described above, the base member 22 is defined by the top face 32, the bottom face 33, the first end 34, and the second end 35. The base member 22 can be generally rectangular as shown in FIG. 2, but other shapes may be suitable. During use, the bottom face 33 is placed on a floor of a room. For this reason, the bottom face 33 is substantially flat in some embodiments (i.e., within 10% of a truly flat surface). In some embodiments, the bottom face 33 may incorporate surface features that increase friction between the floor and the device 20 to limit movement of the device 20 during use.

Figure 3:
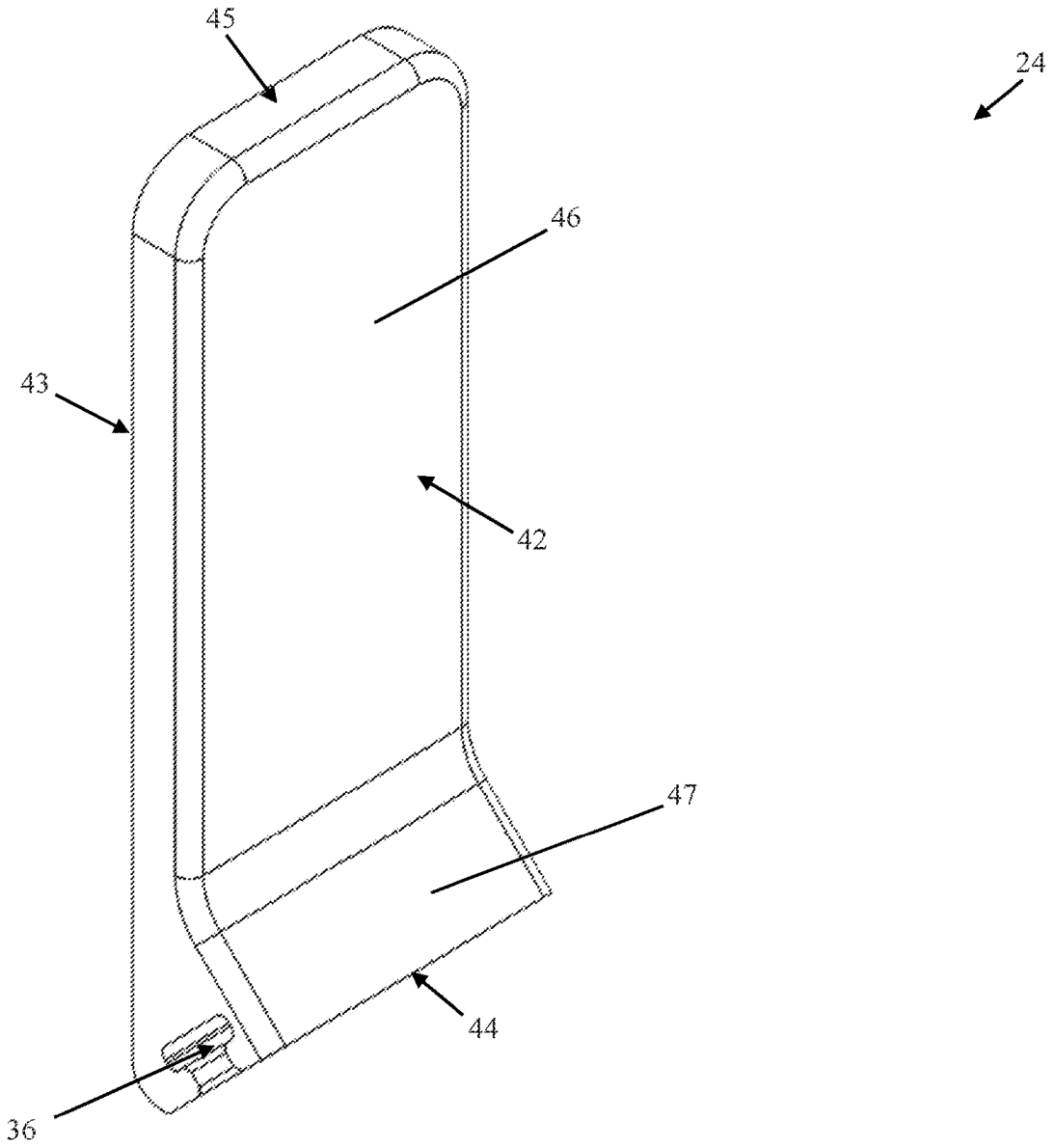
FIG. 3 is a perspective view of an upright member of the foot stretching device of FIG. 1.

FIG. 3 illustrates a perspective view of the upright member 24. The upright member 24 can have an elongated shape and defines a front face 42 opposite a back face 43 (referenced generally), and a first end 44 opposite a second end 45. The upright member 24 can be generally rectangular as shown in FIG. 3, but other shapes may be suitable. In the assembled state, the device 20 (FIG. 1) is configured such that the back face 43 is positioned against a wall of a room during use. For this reason, the back face 43 can be substantially flat (i.e., within 10% of a truly flat surface). In some embodiments, the back face 43 may incorporate surface features that increase friction between the wall and the device 20 to limit movement of the device during use. In other embodiments, the back face 43 can incorporate surface features (e.g., depressions, raised surfaces, etc.) that allow the device 20 to sit flush with the wall if the wall has moldings or other adaptations. In yet other embodiments, the stretching devices of the present disclosure can further include an offset body (not shown) that is selectively secured to the back face 43 (e.g., the offset body and the back face 43 can carry complementary securement strips (such as complementary hook-and-loop strips available under the tradename Velcro®), a pressure sensitive adhesive can be provided on one or both of the offset body and the back face 43, a mechanical fastener can be included, etc.); where desired, the offset body is attached to the back face 43 and serves to accommodate a thickness of wall variations (e.g., molding) and allow the back face 43 to sit flush with the wall.

With respect to the front face 42, the device 20 (FIG. 1) is configured such that during use, the user's foot engages with the front face 42 of the upright member 24. In some embodiments, a shape of the upright member 24 (in combination with an arrangement of the upright member 24 relative to the base member 22 upon final assembly) formats the front face 42 to be conducive to stretching exercises beneficial for treatment of plantar fasciitis as described in greater detail below. For example, the front face 42 can provide or define a receiving zone 46 (referenced generally), adjacent to and extending from the second end 45, that is substantially flat or substantially planar (i.e., within 10% of a truly flat or truly planar surface) and intended, for example, for placement of the bottom of a user's forefoot. Other portions of the front face 42 may or may not deviate from the substantially planar receiving zone 46 (e.g., a transition zone 47 can be provided adjacent the first end 44 at which a thickness of the upright member 24 is increased to accommodate mounting features (described below) that promote assembly with the base member 22 (FIG. 1)). Thus, in some embodiments, the receiving zone 46 can be considered the entire length of the flat and planar portion of the front face 42. Other shapes are also envisioned. The front face 42 may also have surface features that enable better engagement with the foot during use, including a texture.

Figure 4:
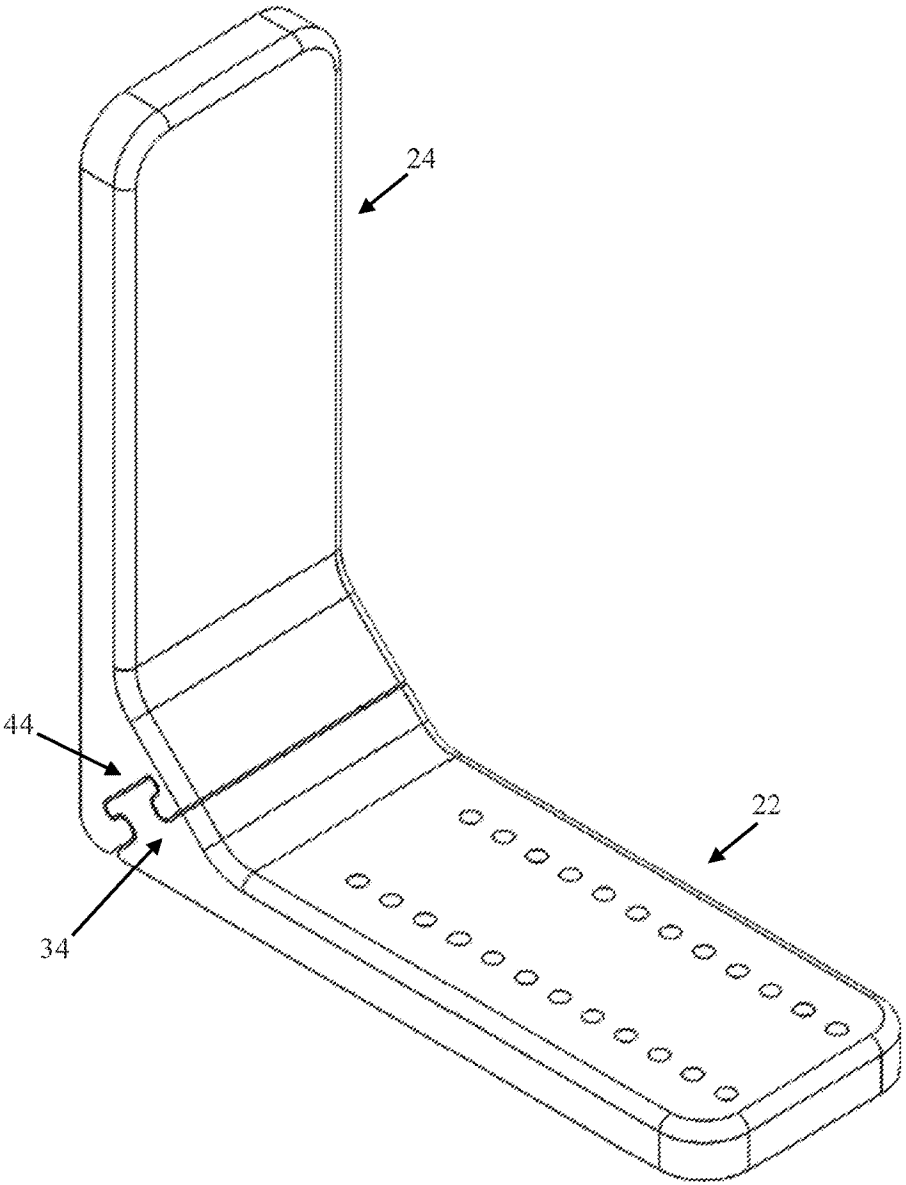
FIG. 4 is a perspective view of the base member and upright member jointly connected of the foot stretching device of FIG. 1.

FIG. 4 illustrates a perspective view of the base member 22 and upright member 24 jointly connected to optionally form a right angle as described below, with the upright member 24 projecting upwardly from the base member 22 in a direction opposite the bottom face 33 of the base member 22. In some embodiments, the first end 34 of the base member 22 may be configured to jointly connect to the first end 44 of the upright member 24. FIG. 2 illustrates the first end 34 of the base member 22 forming a tail 37 of a dovetail or tongue-in-groove configuration. FIG. 3 illustrates the first end 44 of the upright member 24 forming a socket 36 of the dovetail or tongue-in-groove configuration. In other embodiments, the base member 22 and upright member 24 may incorporate any other joint configuration common in the field that facilitates assembly of the base member 22 with the upright member 24 in a manner optionally creating a 90 degree or right angle between the bottom face 33 of the base member 22 and the back face 43 of the upright member 24 (e.g., in some embodiments, a major plane of the bottom face 33 and a major plane of the back face 43 are substantially perpendicular). The base member 22 and upright member 24 may be disassembled from each other for storage or transportation purposes. In other embodiments, the base member 22 and the upright member 24 can be more permanently attached to one another (e.g., the base member 22 and the upright member 24 can optionally be formed as a single, homogenous body).

Figure 5:
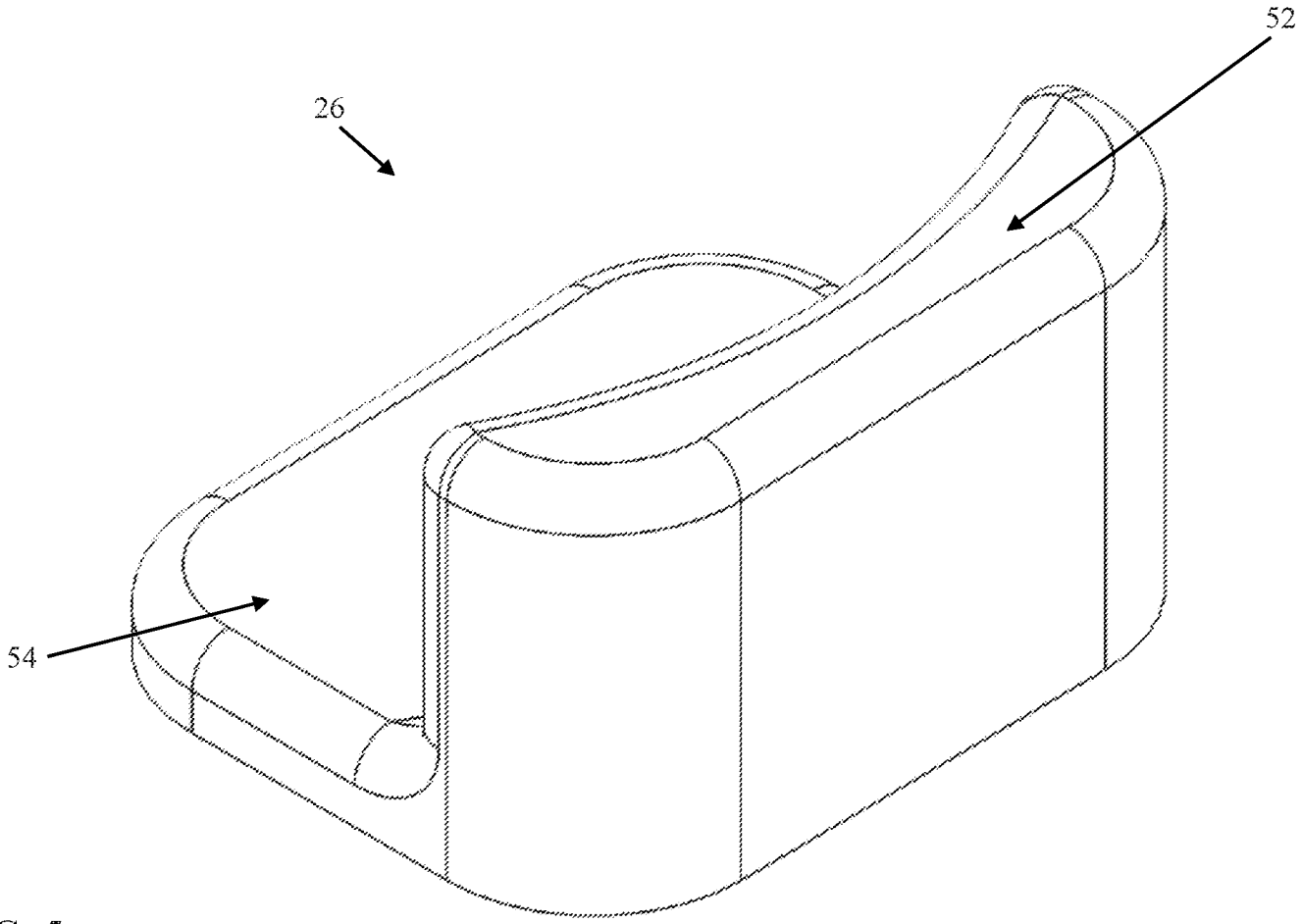
FIG. 5 is a perspective view of a heelpiece of the foot stretching device of FIG. 1.

FIG. 5 illustrates an example of the heelpiece 26 of the foot stretching device 20. The heelpiece 26, when assembled to the base member 22 (FIG. 1), provides support and resistance to a user's heel during use. In some embodiments, the heelpiece 26 may include an upper portion 52 and a bottom portion 54. The upper portion 52 and bottom portion 54 may form a right angle, although other angles are also acceptable. The upper portion 52 may have a shape adapted to comfortably or ergonomically receive the heel of the user, for example it may have a concave shape or other shapes to adapt to a user's heel. In some embodiments, the heelpiece 26 can include or form a textured surface to minimize slippage of the user's heel during use.

Figure 6:
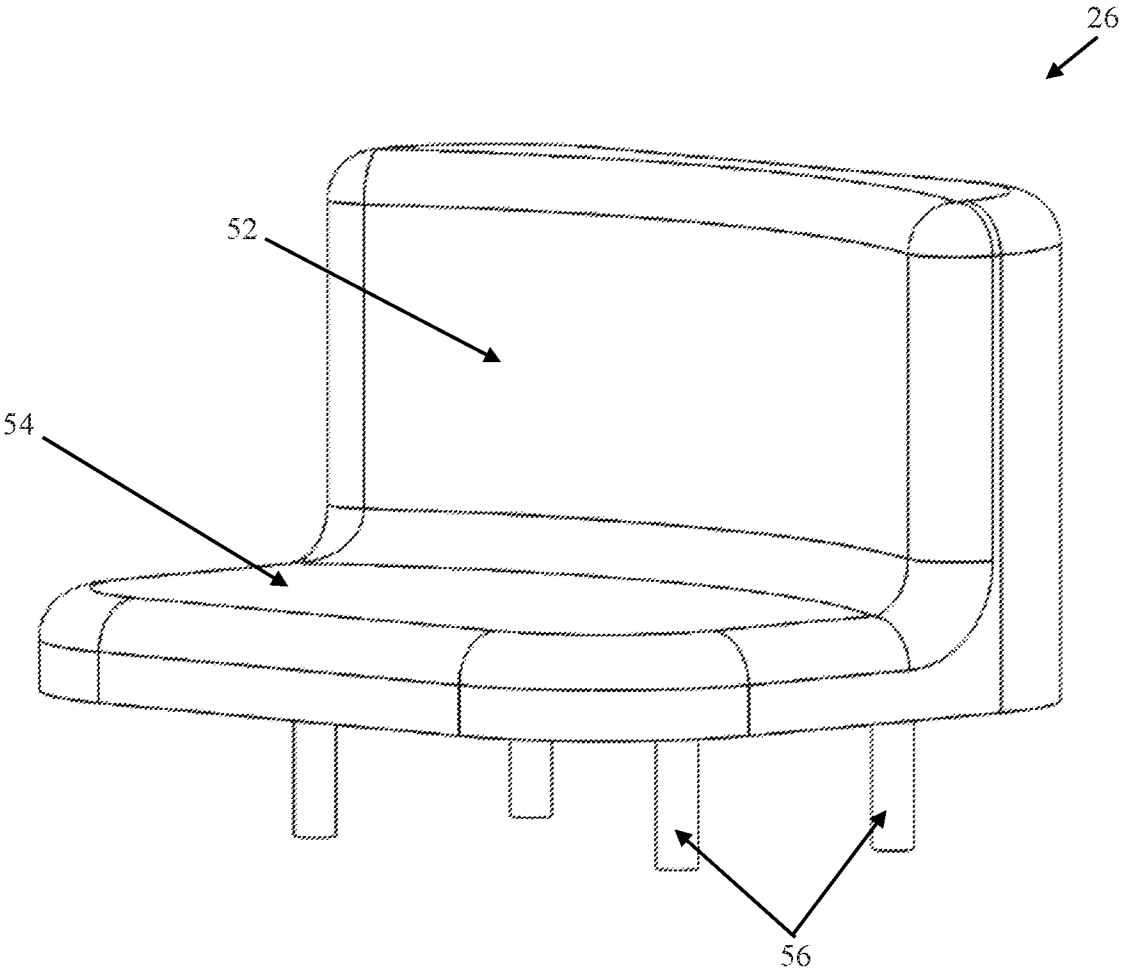
FIG. 6 is another perspective view of the heelpiece of FIG. 5.

In some embodiments, the heelpiece 26 may be removably attached to the top face 32 of the base member 22 to accommodate various foot sizes and/or to promote a desired stretch. The heelpiece 26 may be removably attached at various positions between the first end 34 and the second end 35 of the base member 22. Optimal positions of the heelpiece 26 may be determined by a physician (or the user) to ensure proper stretching of the foot. The attachment of the heelpiece 26 to the base member 22 can have a variety of configurations. For example, the base member 22 may have a plurality of holes 38 open to the top face 32 and adapted to receive and releasably maintain a plurality of pins 56 extending from the heelpiece 26. The pins 56 can be removed from the holes 38 to adjust the placement of the heelpiece 26 along the base member 22 (and thus a distance between the heelpiece 26 and the upright member 24 as desired to best accommodate the size of a particular user's foot and/or desired degree of stretch). FIG. 6 illustrates an embodiment of the heelpiece 26 where the plurality of pins 56 extend from the bottom portion 54. One example of an attachment configuration is two parallel sets of the holes 38 spaced along the top face 32 of the base member 22 configured to releasably maintain a set of pins 56 extending from the bottom portion 54 of the heelpiece 26. Regardless of an exact connection format, engagement between the heelpiece 26 and the base member 22 is sufficiently robust to resist expected forces applied to the heelpiece 26 during use of the device 20 in performing a stretching exercise.

Figure 7:
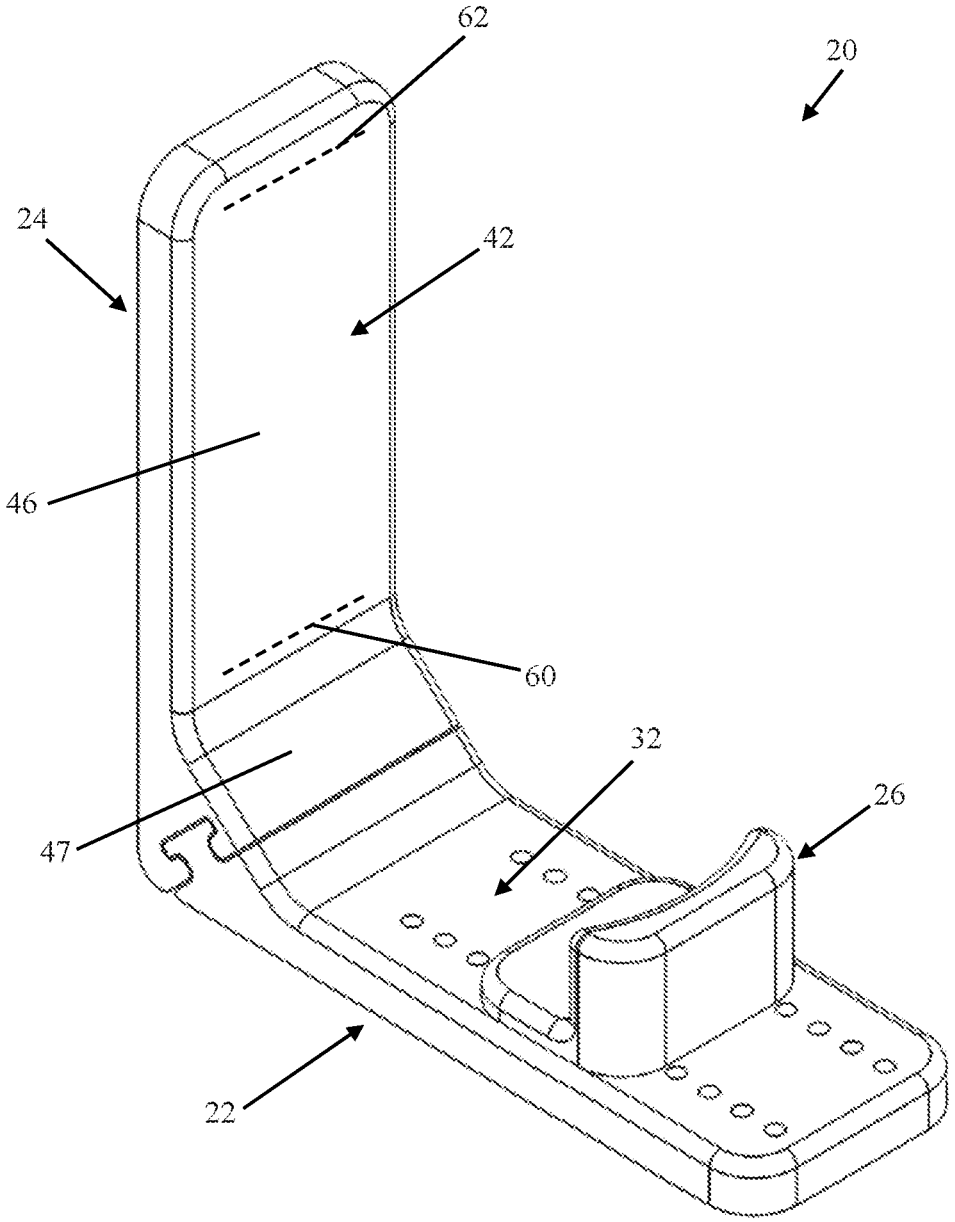
FIG. 7 is a perspective view of the foot stretching device of FIG. 1.

With reference to FIGS. 1-6, one or more features of the foot stretching devices of the present disclosure promote stretching of the plantar fascia. As a point of reference, with some foot stretching exercises of the present disclosure, the hindfoot (e.g., heel) of the foot to be stretched is placed into contact with the heelpiece 26, and the bottom of the forefoot (e.g., toes and ball of the foot) of the foot to be stretched is located against the front face 42 of the upright member 24. With this approach, the bottom arch of the foot is not in contact with the device 20 and this promotes stretching of the plantar fascia. More particularly, and with reference to FIG. 7, a foot stretching exercise intended to stretch the plantar fascia includes the bottom of the forefoot placed against the receiving zone 46 of the front face 42 of the upright member 24. To promote stretching of the plantar fascia, a location or distance of the heelpiece 26 relative to a plane of the receiving zone 46 is adjusted or selected so that when the heel of the foot is against the heelpiece 26 and the forefoot is placed on the receiving zone 46, the foot and ankle are stretched. This allows the forefoot to be in a fixed position against the receiving zone 46 (e.g., at or above a hypothetical lower region represented by a dashed line 60, or at or below a hypothetical upper region represented by a dashed line 62 in FIG. 7) and the heel to be in a fixed position on the heelpiece 26. An open space is created between the bottom arch of the user's foot and all surfaces of the foot stretching device 20. The resulting forces from the user gently pushing their body weight into the foot stretching device 20 cause a stretch of the plantar fascia and Achilles tendon. The adjustable construction of the heelpiece 26 relative to the base member 22 (and thus relative to the upright member 24) as described above permits a user to achieve this foot placement/arrangement regardless of the actual size of the particular user's foot. Further, a user has the ability to attain a more advanced or aggressive stretch by locating the heelpiece 26 closer to the upright member 24.

Regardless, once the foot to be stretched is positioned as described above, an effective stretch of the plantar fascia can be achieved by simply shifting weight onto the foot to be stretched and/or leaning forward. The upright member 24 and the heelpiece 26 hold the forefoot and the heel in a fixed position, allowing the force to be applied through the plantar fascia. While in this stretching position, muscles, tendons, and ligaments of the foot and ankle are lengthened. Due to the spacing naturally achieved between the bottom of the foot arch and the surfaces of the device 20, there is no pressure over the plantar fascia and the device 20 itself does not impede or resist free stretching. Along these same lines, a bottom of the user's heel is supported by the bottom portion 54 of the heelpiece 26, thus raising the bottom of the foot to be stretched above the top face 32 of the base member 22 (i.e., the desired open spacing between the foot to be stretched and surfaces of the device 20 is enhanced by a thickness of the bottom portion 54). The room's wall prevents the foot stretching device 20 from moving (e.g., as the user transfers his/her weight forward onto the forefoot in performing the stretch, a resultant force applied onto the upright member 24 is resisted by the wall). Other stretching exercises are also available with the stretching devices of the present disclosure, including those in which a portion of the user's foot (e.g., forefoot) is in contact with the transition zone 47 of the front face 42 of the upright member 24.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

What is claimed is:

1. A foot stretching device comprising:

a base member defining a top face, a bottom face, a first end, and a second end, the bottom face configured to rest on a floor during use;

an upright member configured for positioning against a wall during use, the upright member extending from the first end of the base member in a direction opposite the bottom face of the base member in an assembled state, the upright member and the base member forming a right angle;

wherein the upright member defines a front face opposite a back face, and further wherein in the assembled state a distance between the front face and the second end of the base member is less than a distance between the back face and the second end of the base member, and further wherein the front face defines a receiving zone that is substantially planar and arranged perpendicular to a major plane of the top face of the base member; and a heelpiece removably attached to the top face of the base member between the first and second ends of the base member.

2. The foot stretching device of claim 1, wherein the upright member and the base member are jointly connected.

3. The foot stretching device of claim 2, further wherein the base member and upright member are configured to form a dovetail joint.

4. The foot stretching device of claim 1, wherein the heelpiece includes an upper portion and a bottom portion, the upper portion having a concave shape for receiving a heel of a user.

5. The foot stretching device of claim 4, wherein the heelpiece further includes a plurality of pins extending from the bottom portion, and the base member includes a plurality of holes open to the top face, and further wherein each of the plurality of holes are configured to releasably receive and maintain a respective one of the plurality of pins of the heelpiece.

6. The foot stretching device of claim 1, wherein the heelpiece is adapted to receive a heel of a foot of a user.

7. The foot stretching device of claim 1, wherein the heelpiece is removably attached to the top face of the base member at a plurality of positions between the first end and the second end of the base member.

8. The foot stretching device of claim 1, wherein the foot stretching device is configured such that a foot of a user is received by the heelpiece and the foot also engages with the upright member.

9. The foot stretching device of claim 1, wherein in the assembled state, a major plane of the bottom face of the base member and a major plane of a back face of the upright member are perpendicular.

10. The foot stretching device of claim 1, wherein in the assembled state, the heelpiece and the upright member project in the same direction from the top face of the base member.

11. The foot stretching device of claim 1, wherein the heelpiece includes an upper portion and a bottom portion, and further wherein in the assembled state:

the bottom portion of the heelpiece rests on top of the top face of the base member;

a segment of the upper portion of the heelpiece projects upwardly from the bottom portion of the heelpiece in a direction away from the top face of the base member; and a segment of the bottom portion of the heelpiece projects away from the upper portion of the heelpiece in a direction of the first end of the base member;

wherein the stretching device is configured such that in the assembled state, a bottom of a heel of a user's foot nests against the bottom portion of the heelpiece and a back of the heel of the user's foot nests against the upper portion of the heelpiece.

12. A foot stretching device comprising:

a base member defining a top face, a bottom face, a first end, and a second end, the bottom face configured to rest on a floor during use;

an upright member configured for positioning against a wall during use, the upright member extending from the first end of the base member in a direction opposite the bottom face of the base member in an assembled state, the upright member and the base member forming a right angle; and a heelpiece removably attached to the top face of the base member between the first and second ends of the base member;

wherein the heelpiece further includes an upper portion and a bottom portion, the upper portion having a concave shape for receiving a heel of a user, and a plurality of pins extending from the bottom portion, and the base member includes a plurality of holes open to the top face, and further wherein each of the plurality of holes are configured to releasably receive and maintain a respective one of the plurality of pins of the heelpiece.

13. A foot stretching device comprising:

a base member defining a top face, a bottom face, a first end, and a second end, the bottom face configured to rest on a floor during use;

an upright member configured for positioning against a wall during use, the upright member extending from the first end of the base member in a direction opposite the bottom face of the base member in an assembled state, the upright member and the base member forming a right angle; and a heelpiece removably attached to the top face of the base member between the first and second ends of the base member;

wherein the heelpiece includes an upper portion and a bottom portion, and further wherein in the assembled state:

the bottom portion of the heelpiece rests on top of the top face of the base member;

a segment of the upper portion of the heelpiece projects upwardly from the bottom portion of the heelpiece in a direction away from the top face of the base member; and a segment of the bottom portion of the heelpiece projects away from the upper portion of the heelpiece in a direction of the first end of the base member;

wherein the stretching device is configured such that in the assembled state, a bottom of a heel of a user's foot nests against the bottom portion of the heelpiece and a back of the heel of the user's foot nests against the upper portion of the heelpiece.

* * * * *